United States Patent [19]

Bragagnini

[11] Patent Number: 4,614,486

[45] Date of Patent: Sep. 30, 1986

[54] PORTABLE APPARATUS FOR COMPACTING AND LEVELING A POURED FLOOR

[76] Inventor: Bruno Bragagnini, 835 Farrel St., Kalamazoo, Mich. 49007

[21] Appl. No.: 669,287

[22] Filed: Nov. 7, 1984

[51] Int. Cl.[4] ..... E01C 19/28

[52] U.S. Cl. ..... 425/62; 404/85; 404/103; 404/117; 404/120; 404/126; 404/129; 425/456

[58] Field of Search ..... 425/62–64, 425/219, 374, 456; 404/85, 96, 103, 105, 106, 113, 114, 117–120, 126, 129, 133

[56] References Cited

U.S. PATENT DOCUMENTS

| | | | |
|---|---|---|---|
| Re. 26,675 | 9/1969 | Ferm et al. | 404/129 |
| 1,554,072 | 9/1925 | Durrenfeld | 404/103 |
| 1,897,605 | 2/1933 | Clifford | 404/103 |
| 2,597,221 | 5/1952 | Barber | 404/103 |
| 2,878,731 | 3/1959 | Kressin | 404/85 |
| 3,137,220 | 6/1964 | Smith | 404/98 |
| 3,362,142 | 1/1968 | Crane et al. | 425/62 |
| 3,377,933 | 4/1968 | Dale | 404/106 |
| 3,416,417 | 12/1968 | McIlrath et al. | 404/85 |
| 3,450,012 | 6/1969 | Beierlein et al. | 404/103 |
| 3,515,042 | 6/1970 | Austin | 404/103 |
| 3,540,360 | 11/1970 | Snow, Jr. | 404/120 |
| 3,554,100 | 1/1971 | Mauldin | 404/117 |
| 3,797,953 | 3/1974 | Lindskog | 404/103 |
| 4,043,738 | 8/1977 | Modesto et al. | 404/103 |
| 4,219,287 | 8/1980 | Marks | 404/117 |
| 4,280,800 | 7/1981 | Bunn | 425/62 |
| 4,298,555 | 11/1981 | Weltmer | 264/31 |
| 4,323,321 | 4/1982 | Dale | 404/105 |
| 4,367,880 | 1/1983 | Harding | 404/85 |
| 4,496,504 | 1/1985 | Steenson et al. | 425/456 |

*Primary Examiner*—Jay H. Woo
*Assistant Examiner*—James C. Housel
*Attorney, Agent, or Firm*—Flynn, Thiel, Boutell & Tanis

[57] ABSTRACT

A machine for compacting and leveling a poured floor covering. The machine includes a frame having a pair of side members and a pair of parallel, ground engaging, cylindrical rollers rotatably supported on the side members and supporting the frame for movement in forward and reverse directions. A screw member is rotatably supported on the side members and has a right-hand screw segment over a portion of the length thereof and a left-hand screw segment over a remainder portion of the length thereof. If desired, a second screw member, a trowelling mechanism and a vibratory mechanism, can be provided. Structure is provided on the front screw member for pushing the material arriving at the region between the screw segments forwardly of the machine, the leveled material passing under the screw member, as the machine is moved forwardly, being compacted by successive passage beneath the cylindrical rollers.

12 Claims, 16 Drawing Figures

FIG. 7
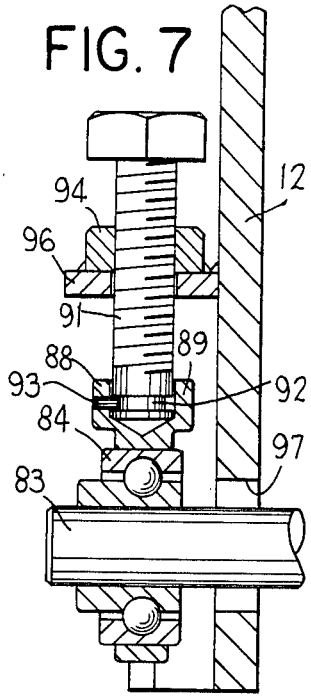
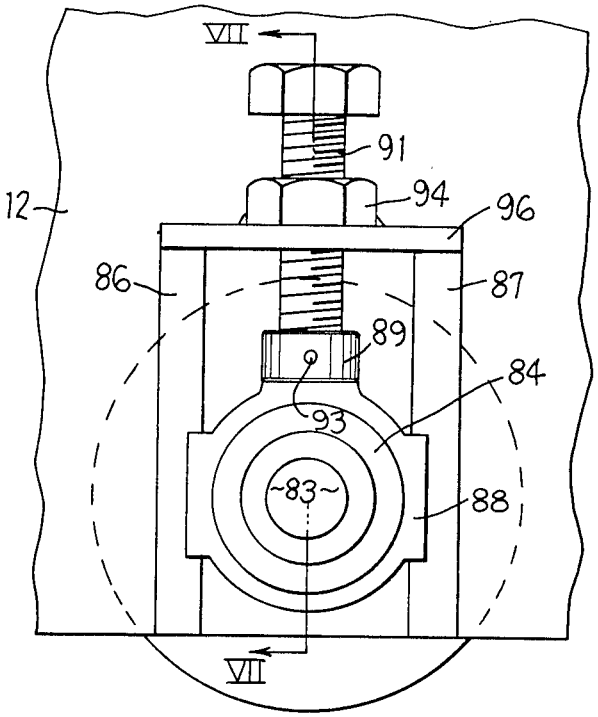
FIG. 6
FIG. 5
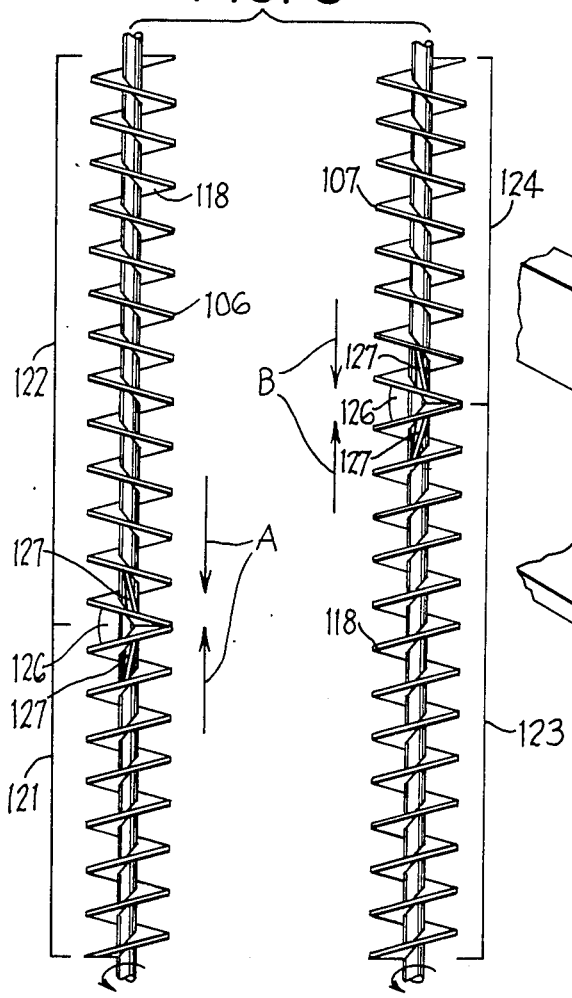
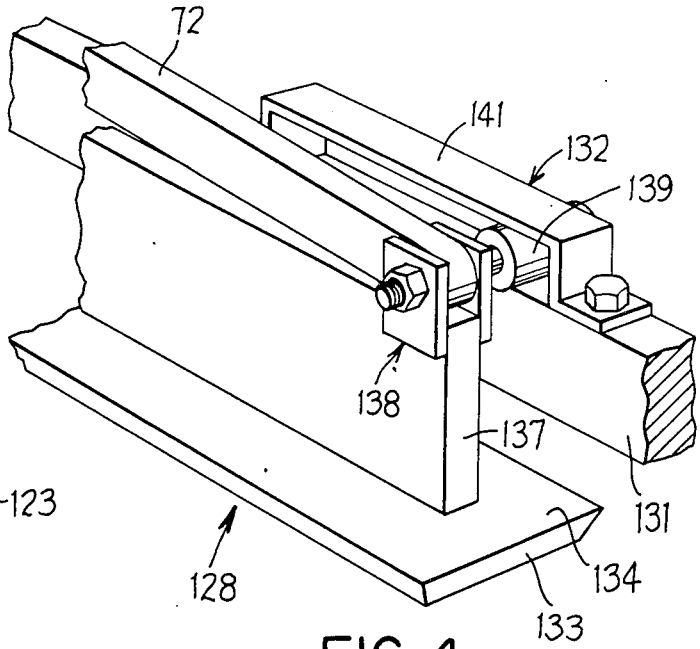
FIG. 4

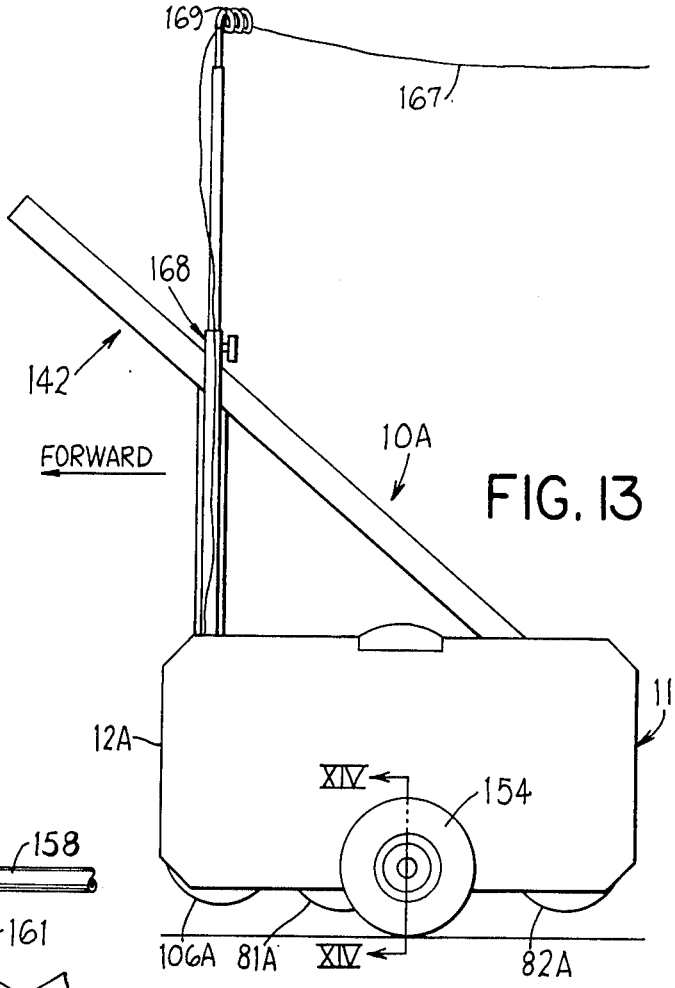
FIG. 13
FIG. 14
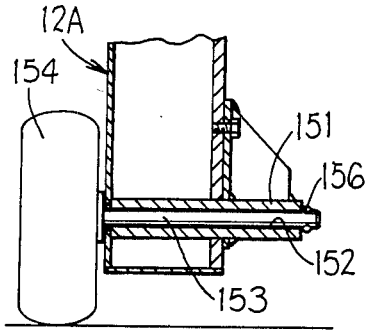
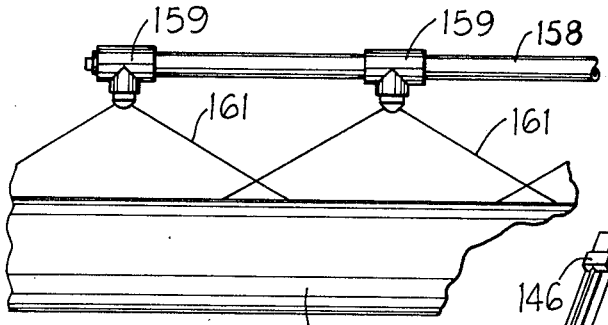
FIG. 16
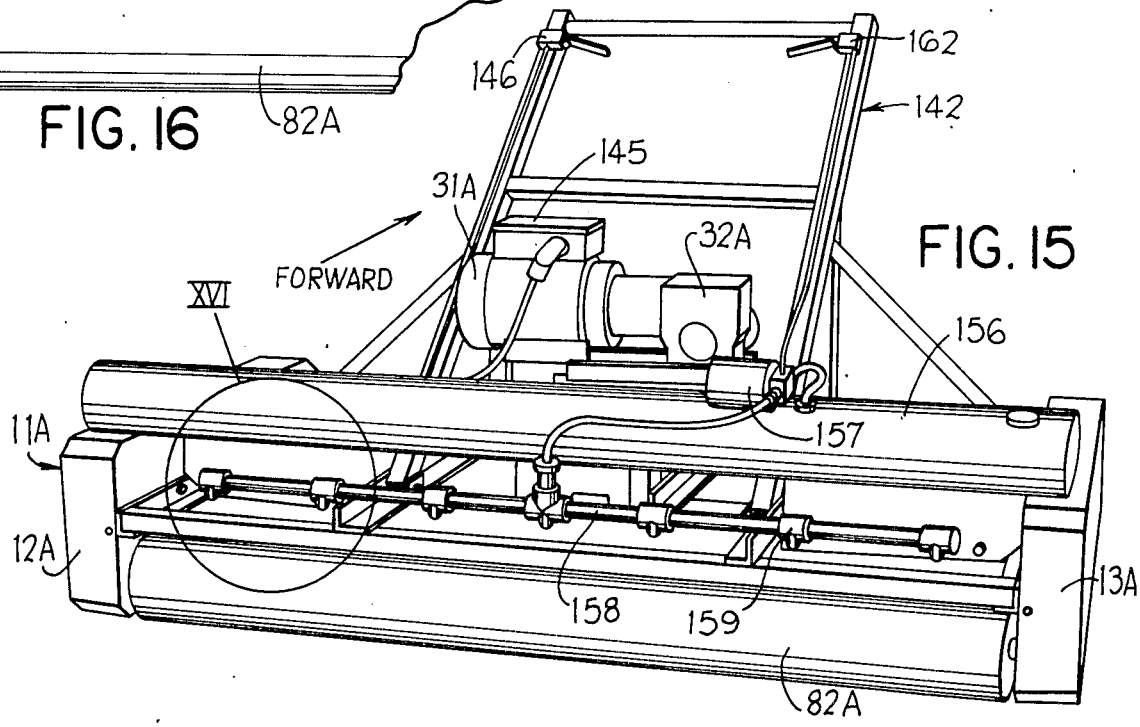
FIG. 15

PORTABLE APPARATUS FOR COMPACTING AND LEVELING A POURED FLOOR

FIELD OF THE INVENTION

This invention relates to a portable machine for compacting and leveling a layer of fluid floor covering as it is moved thereover.

BACKGROUND OF THE INVENTION

In the process of laying a terrazzo floor, it is necessary that the poured floor covering be easily spread about within a boundary defined by separators or the like which are generally oriented in a rectangular or square pattern as shown in FIGS. 8 and 9. It is generally the object of the personnel moving the poured floor covering material about to come reasonably close to placing the prescribed amount of poured floor covering material in each region bounded by the separators so that as the material is trowelled, a certain specified depth of material above the separators will remain. Thereafter, a floor covering grinding machine will be utilized to grind the excess floor covering material down to the prescribed dimension followed by a polishing of the floor covering to enhance the beauty of the terrazzo floor. Many manhours have been necessary in order to spread the poured material about and to have it end up being the prescribed dimension above the plane defined by the top wall of the separators. As the cost of labor increases year after year, terrazzo flooring has become a very expensive item in a building contract causing many customers to opt for different and less expensive types of floor covering.

Accordingly, it is an object of the present invention to provide a machine for compacting and leveling a poured floor covering, which is operable by a single person to enable a compacting and leveling of many square feet of flooring in a given period of time which used to take several workers to accomplish in the same period of time.

It is a further object of the invention to provide a machine, as aforesaid, which has adjustment features thereon enabling the height of the floor covering material above the top edge of the separators to be adjusted to the desired level.

It is a further object of the invention to provide a machine, as aforesaid, wherein poured floor covering material need only be placed in the prescribed regions bounded by the separators with little or no care being given to the amount of such material being placed in each such area to thereby minimize the number of manhours required to spread poured floor covering material about the site.

It is a further object of the invention to provide a machine, as aforesaid, which has poured floor covering material spreading structure to enable the floor covering material to be spread evenly within the region bounded by the separators and to a specified height above the top edge thereof.

It is a further object to provide a machine, as aforesaid, which is self-propelled.

It is a further object of the invention to provide a machine, as aforesaid, which necessitates only a single pass of the machine over the poured floor covering material to produce a floor covering of the desired dimension above the top edge of the separators.

It is a further object of the invention to provide a machine, as aforesaid, which is durable in its construction, simple to operate and requires little or no maintenance.

SUMMARY OF THE INVENTION

The objects and purposes of this invention have been met by providing a machine for compacting and leveling a poured floor covering. The machine has a frame on which is provided a pair of side members. A pair of parallel, ground engaging, cylindrical rollers are provided with appropriate support structure for rotatably supporting the rollers on the side members to enable the frame to move forwardly and rearwardly. A screw member having a right-hand screw segment over a portion of the length thereof and a left-hand screw segment over a remainder portion of the length thereof is provided with appropriate support means enabling the screw member to rotate. The theoretical cylinder defined by the screw segments is elevated above a plane defined by the lines of contact of the cylindrical rollers with the ground. The screw member has structure thereon for facilitating a pushing of the balance of the poured floor covering material forwardly of the machine with the leveled material passing under the screw member as the machine is moved forwardly, being compacted by the cylindrical rollers as they move thereover.

BRIEF DESCRIPTION OF THE DRAWINGS

Further objects and purposes of this invention will be apparent to persons acquainted with apparatus of this general type upon reading the following specification and inspecting the accompanying drawings, in which:

FIG. 4 is an enlarged perspective view of the support structure for the trowelling mechanism;

FIG. 5 is a plan view of the two screw members, each of which has left-hand and right-hand screw segments thereon;

FIG. 6 is an enlarged fragment of a portion of FIG. 1;

FIG. 7 is a sectional view taken along the line VII—VII of FIG. 6;

FIG. 13 is a left side view of the machine illustrated in FIG. 11 but with removable wheels mounted in association therewith;

FIG. 14 is a sectional view taken along the line XIV—XIV of FIG. 13;

FIG. 15 is a perspective view of a third embodiment of the machine;

FIG. 16 is an enlarged view of the encircled portion marked XVI in FIG. 15.

Figure 1:
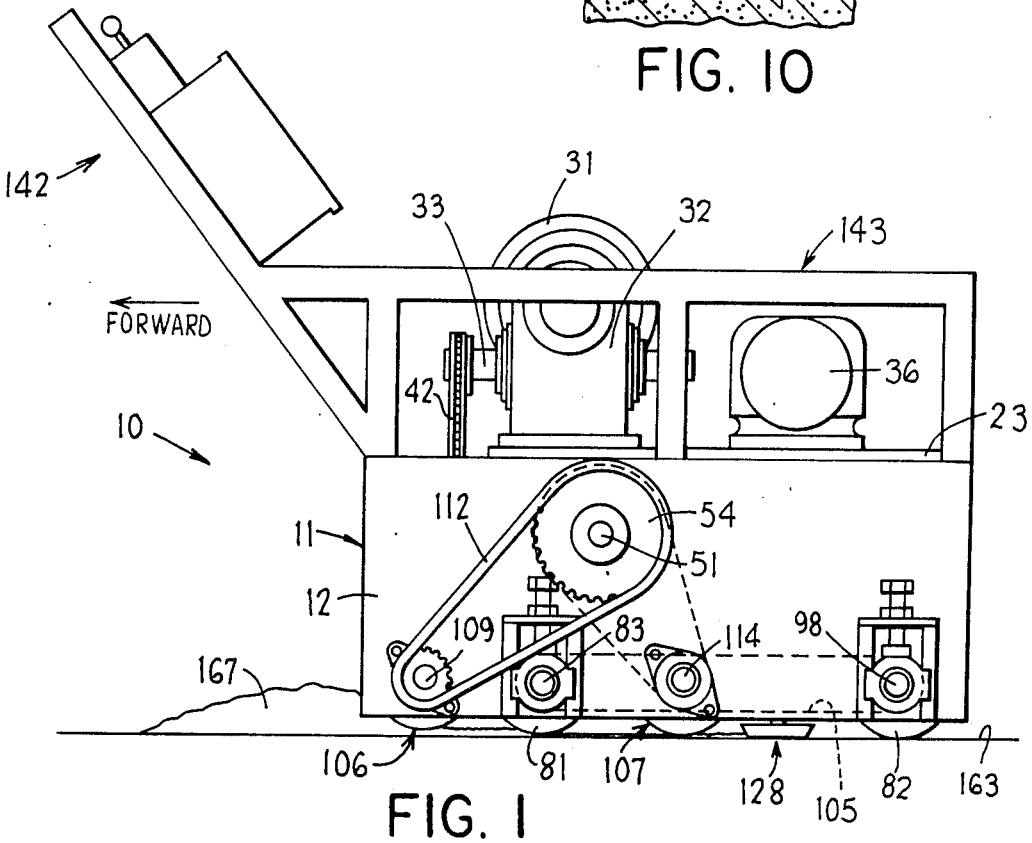
FIG. 1 is a side elevational view of a first embodiment of the machine for compacting and leveling a poured floor covering.

Certain terminology will be used in the following description for convenience in reference only and will not be limiting. The words "up", "down", "left" and "right" will designate directions in the drawings to which reference is made. The words "in" and "out" will refer to directions toward and away from, respectively, the geometric center of the machine and designated parts thereof. The words "front" and "rear" will refer to the front and rear of the machine, the front being that side of the machine having the handle, that is, the left side of FIG. 1. Such terminology will include the words above specifically mentioned, derivatives thereof and words of similar import.

DETAILED DESCRIPTION

Figure 2:
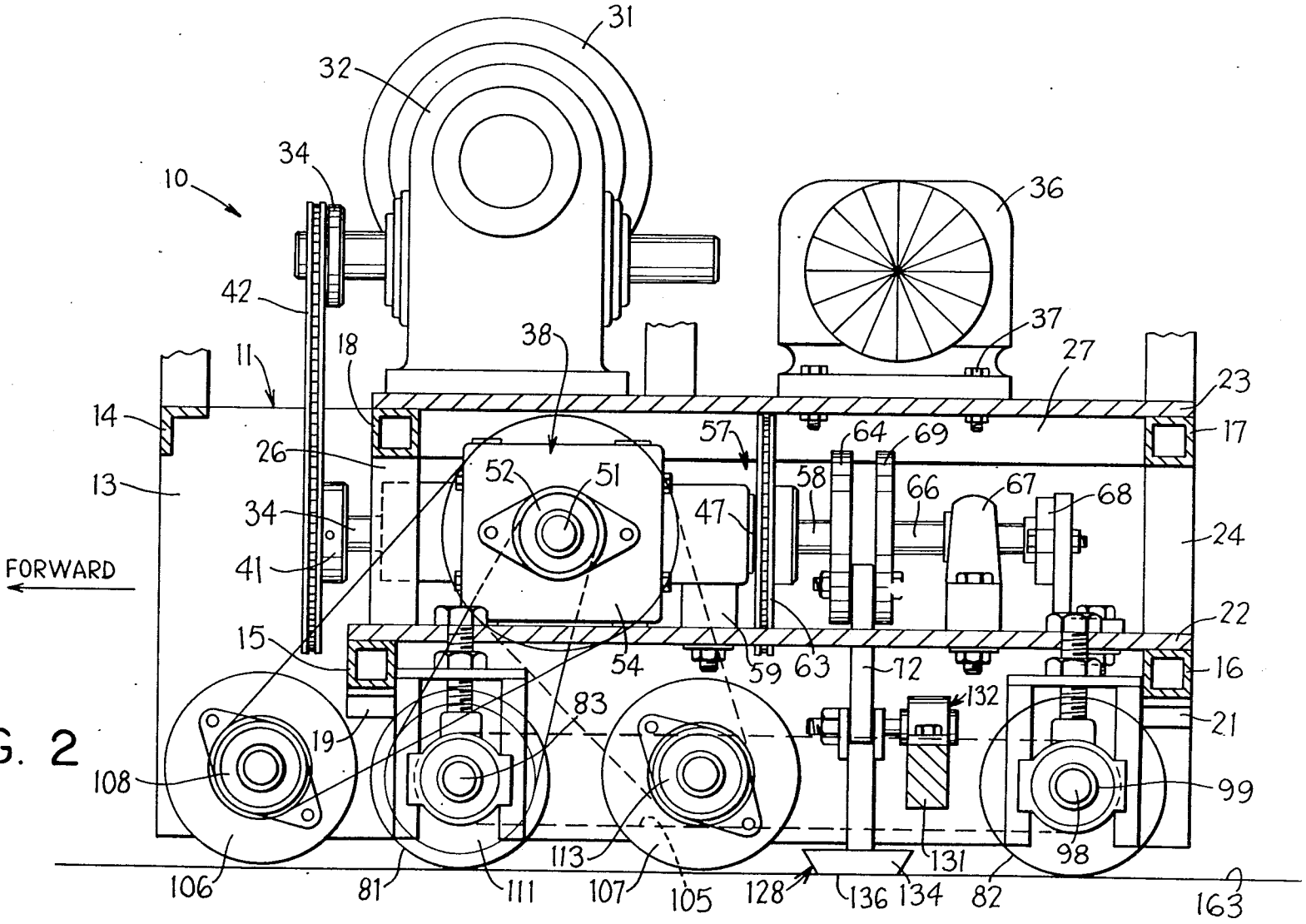
FIG. 2 is an enlarged side view of the machine with one of the side plates being removed.
Figure 8:
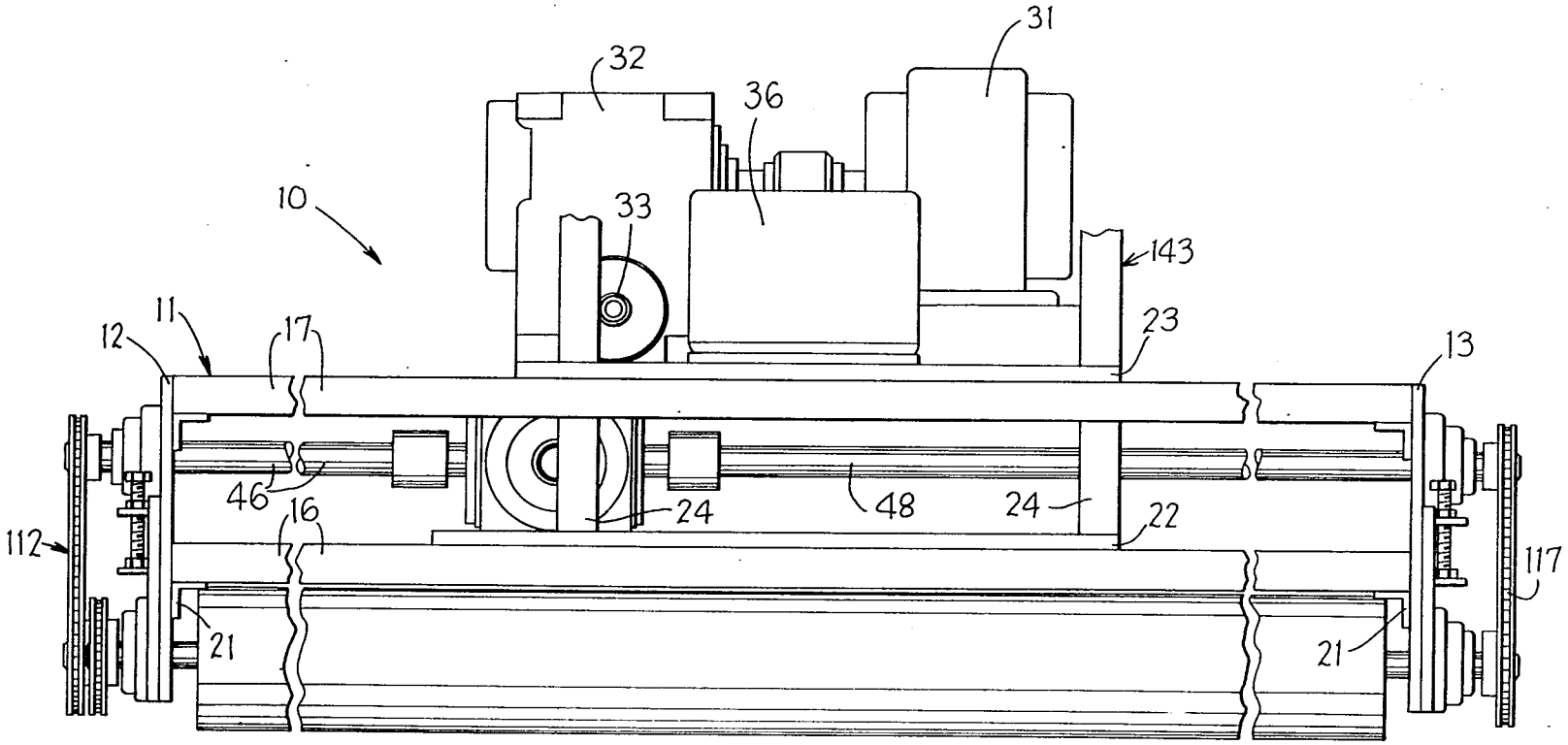
FIG. 8 is a rear elevational view of the machine illustrated in FIG. 1.

A first embodiment of a machine 10 for compacting and leveling a poured floor covering is illustrated in FIGS. 1 to 8. The machine includes a frame 11 having a pair of laterally spaced side plates 12 and 13 interconnected by plural laterally extending beam members 14, 15, 16, 17 and 18 (FIG. 2). In this particular embodiment, the beam member 14 is an elongated L-shaped angle and the remainder of the beam members 15 to 18 are hollow tubes having a rectangular or square shape. Further, the lowermost beam members 15 and 16 are mounted on brackets 19 and 21 fixedly secured to the side members 12 and 13 and serve to support the beam members 15 and 16. The top surface of the two beam members 15 and 16 are preferably coplanar and are adapted to support a plate 22 thereon. In fact, the plate 22 is secured to the beam members 15 and 16 by conventional means, as by bolts, not illustrated. Similarly, the two beam members are supported on brackets similar to the brackets 17 and 18 and the upper surface of the two beam members 17 and 18 are preferably coplanar and support thereon a plate 23. The plate 23 is fixedly secured to the beam members 17 and 18 by conventional means, as by bolts, not illustrated. Midlength of the vertically spaced beam members 16 and 17 there are provided a pair of brace members 24 (FIGS. 2 and 8). Similarly, between the vertically spaced beam members 15 and 18 there are provided a pair of brace members 26 (FIG. 2). The brace members 24 and 26 serve to rigidify the frame 11. An additional beam member 27 is connected to and extends between the beam members 17 and 18 and extend along the underside of the plate 23 along the lateral edges thereof. Thus, the laterally extending beam members 17 and 18 as well as the longitudinally extending beam members 27 define a rectangular frame on which is mounted the plate 23. A further set of brace members 28 are connected to and extend between the top surface of the plate 22 and the underside of the beam members 27 to provide additional strength to the frame 11.

A reversible, electrically driven motor 31 and a gear reducer 32 are mounted on the upper surface of the plate 23 by conventional means, as by bolts, not illustrated. The gear reducer 32 has an output shaft 33 oriented in a direction parallel to the side plates 12 and 13. The forward end of the output shaft 33 has a sprocket 34 mounted thereon and rotatable therewith.

A vibratory mechanism 36 is also mounted on the upper surface of the plate 23 and is secured thereto by a plurality of bolts 37. In this particular embodiment, the vibratory mechanism 36 is electrically driven.

A differential gear box 38 is mounted on the upper surface of the plate 22 below the motor 31 and gear reducer 32. The differential gear box 38 has an input shaft 39 to which is secured a sprocket 41 radially aligned with the sprocket 34 on the output shaft 33 to the gear reducer 32. A chain 42 is utilized to connect the sprockets 34 and 41. The differential gear box 38 has a plurality of output shafts 46, 47 and 48.

Figure 3:
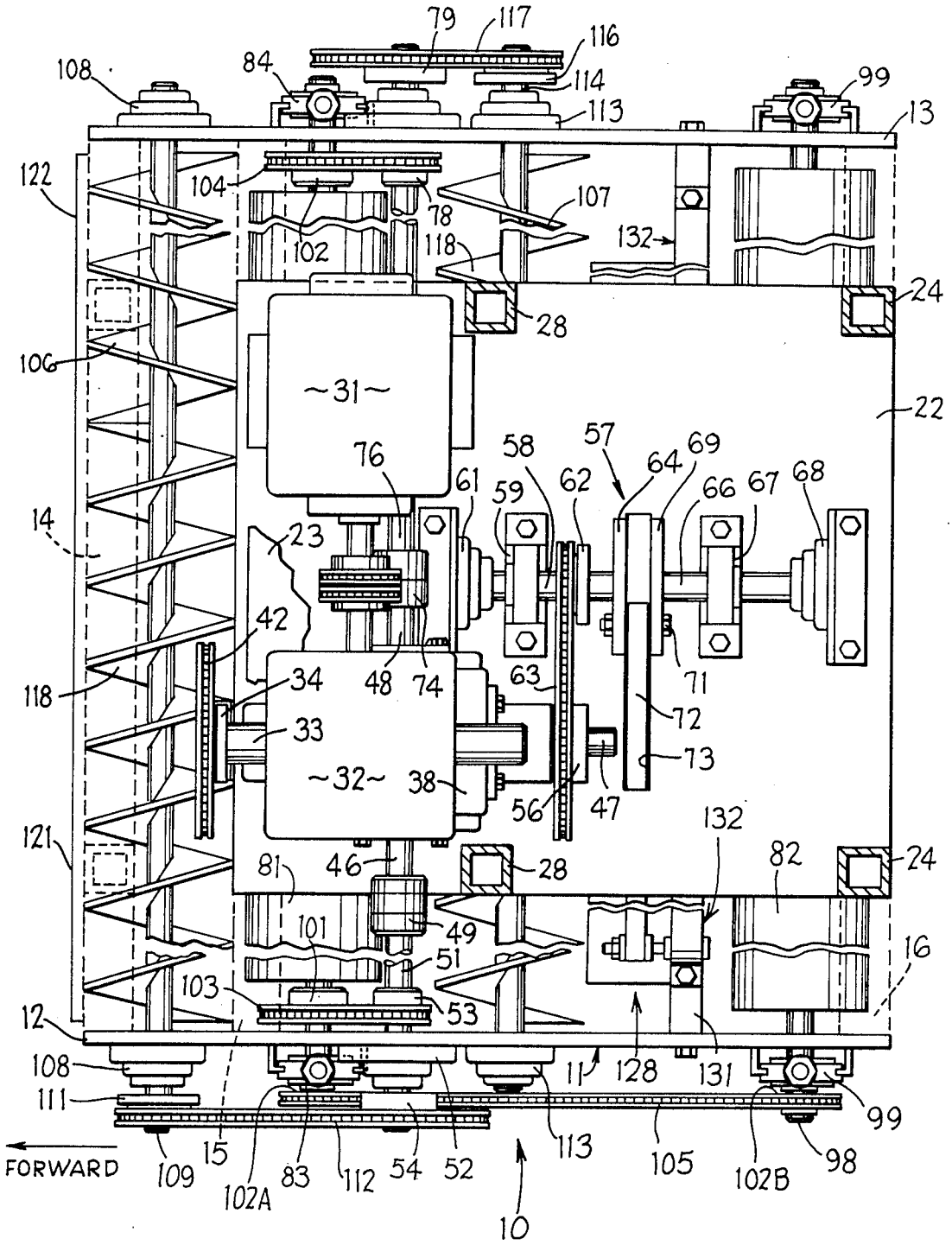
FIG. 3 is a top view of the machine with a majority of the topmost support plate being removed.

The output shaft 46 is connected through a shaft coupler 49 to a shaft extension member 51 which is rotatably journalled in a bearing structure 52 fixed to the side member 12. A pair of sprocket members 53 and 54 are secured to the shaft extension 51 and are rotatable therewith. In this particular embodiment, the sprocket member 53 and the sprocket member 54 are mounted on opposite sides of the side member 12 (FIG. 3).

The output shaft 47 has a sprocket member 56 secured thereto and is rotatable therewith. Associated with the shaft 47 and the sprocket member 56 is a reciprocal drive mechanism 57 mounted on the upper surface of the plate 22. More specifically, a shaft 58 is journalled in axially spaced bearing members 59 and 61. The shaft 58 has fixedly mounted thereon a sprocket member 62 which is radially aligned with the sprocket member 56 on the output shaft 47. A chain 63 interconnects the sprocket members 56 and 62. A disk 64 is secured to the end of the shaft 58 remote from the bearing member 61. The purpose of the plate 64 will be explained below.

The reciprocating mechanism 57 also includes an additional shaft 66 which is coaxial with the shaft 58. The shaft 66 is rotatably mounted in axially spaced bearing members 67 and 68. A disk 69 is secured to an end of the shaft 66 remote from the bearing member 68. The two disks 64 and 69 are at the mutually adjacent ends of the shafts 58 and 66, respectively, and are axially spaced from each other as illustrated in FIGS. 2 and 3. A bolt 71 having an axis parallel to the coaxially arranged shafts 58 and 66 interconnects the disks 64 and 69. An elongated crank arm 72 is connected pivotally at one end thereof to the portion of the bolt 71 that extends between the disks 64 and 69. The crank arm 72 extends through an opening 73 provided in the plate 24. The purpose of this configuration and of the reciprocating mechanism will be explained below in relationship to a trowelling mechanism.

The output shaft 48 is connected through a shaft coupling 74 to a shaft extension member 76. The shaft extension 76 is rotatably supported in a bearing member 77 mounted on the side member 13. A pair of sprocket members 78 and 79 are secured to the shaft extension 76 and are oriented on opposite sides of the side member 13 as illustrated in FIG. 3.

The frame 11 is movably supported on a pair of longitudinally spaced cylindrical rollers 81 and 82. A smooth cylindrical surface is provided on each roller and the surface is continuous between the side members 12 and 13. The cylindrical roller 81 has a shaft 83 projecting axially from each end. Each shaft end is rotatably supported in a bearing member 84. In this particular embodiment, the bearing members 84 are each supported for vertical movement toward and away from the ground by a structure that is illustrated in FIGS. 6 and 7. Since both bearing members and support structures therefore are identical, only one such structure will be described. More specifically, a pair of L-shaped angle brackets 86 and 87 are secured to the side member 12 so that one leg of the angle bracket extends in a plane generally parallel to the plane of the side member 12.

The bearing member 84 is housed in a slide member 88 having a pair of slots on opposite sides thereof receiving therein the portion of the angle brackets 86 and 87 which extends parallel to the side member 12. This structure facilitates a vertical movement of the slide member 88 up and down. Further, the slide member 88 has a journal 89 at the upper end thereof rotatably receiving therein one end of an externally threaded bolt 91. The bolt 91 is adapted to rotate with respect to the slide member 88. The lower end of the bolt 91 has an annular groove 92 therein and the journal 89 has a radially inwardly extending pin 93 received in the annular groove 92. The pin 93 serves to prevent the bolt from being removed from the journal 89 as well as impart to the slide member 88 a vertical movement in response to a rotation of the bolt 91 threadedly engaged with a nut member 94 fixed to the side member 12 through a bracket 96. As a result of the foregoing structure, the shaft 83 can be vertically adjusted. The opening 97 (FIG. 7) in the side member 12 is preferably enlarged to facilitate the aforesaid vertical movement of the shaft 83.

Similarly, the cylindrical roller 82 has a shaft 98 projecting axially from each end. Here, too, the shaft segments 98 are each rotatably mounted in bearing members 99 secured to the side members 12 and 13. The bearing members 99 are mounted for vertical movement by the exact same structure as is illustrated in FIGS. 6 and 7. Thus, further comment in regard to this vertical adjustment structure is believed unnecessary.

The two shaft segments 83 for the cylindrical roller 81 each have one sprocket member mounted thereon. The two sprocket members 101 and 102 are oriented at the axially opposite ends of the cylindrical roller 81 with the sprocket member 101 being radially aligned with the sprocket member 83 and having a chain 103 interconnecting them. Similarly, the sprocket member 102 is radially aligned with the sprocket member 78 and has a chain 104 interconnecting them. The aforesaid structure will thereby effect, in response to a driving of the differential gear box 38 by the motor 31, a driving rotation of the cylindrical roller 81. Further, and if desired, an appropriate chain take-up mechanism (not illustrated) can be provided to take up the slack in the chains 103 and 104 when the shaft 83 is vertically adjusted. If desired, both the front roller 81 and the rear roller 82 may be driven for rotation. In this instance, a further set of sprockets 102A and 102B (FIG. 3) would be required on the shaft segments 83 and 98 and interconnected by a chain only schematically illustrated at 105 in FIGS. 1 and 2 but shown in solid lines in FIG. 3. Further, a parallel drive chain and sprocket could, if desired, be provided on the other side of the machine 10.

A pair of screw members 106 and 107 are rotatably mounted on and extend between the side members 12 and 13. In this particular embodiment, the screw member 106 is oriented at the front of the machine 10 and is rotatably mounted in bearing members 108. Further, one end of the screw member 106 has a shaft segment 109 extending beyond the associated bearing member 108 and has a sprocket member 111 fixedly secured thereto. The sprocket member 111 is radially aligned with the sprocket member 54 coupled to the output shaft 46 of the differential box 38 and a chain 112 is provided for interconnecting them.

Similarly, the screw member 107 is rotatably supported by bearing members 113 mounted on the side members 12 and 13. The screw member 107 is oriented between the two cylindrical rollers 81 and 82. One end of the screw member 107 has a shaft segment 114 projecting beyond the associated bearing member 113 and has a sprocket member 116 fixedly secured thereto. The sprocket member 116 is radially aligned with the sprocket member 79 fixedly coupled to the output shaft 48 of the differential gear box 38 and a chain 117 is provided for interconnecting them.

The shafts 109 and 114 are both fixedly oriented on the side members 12 and 13. Further, each screw member is composed of a spiral flight 118. The spiral flight 118 for the screw member 106 is divided into two sections, namely, a right-hand screw segment 121 and a left-hand screw segment 122 as shown in FIGS. 3 and 5. For the screw member 107, the left-hand segment is indicated by the reference numeral 123 and the right-hand segment is indicated by the reference numeral 124. As the screw members 106 and 107 are rotated in a counterclockwise direction (FIG. 2), the poured flooring material will be moved by the spiral flights 118 on the respective screw members in the direction of the arrows associated with each screw member illustrated in FIG. 5. That is, the right-hand and left-hand screw segments will move the material in the direction of the arrows A and the flights 118 on the screw member 107 will move the material in the direction of the arrows B. It will be noted that the location whereat the left-hand and right-hand screw segments are joined on each screw member are laterally offset from one another. Further, appropriate blade members 126 and 127 are provided at the mutually adjacent ends of each of the right-hand and left-hand screw segments to push the poured flooring material forwardly of the direction of movement of the machine 10 and prevent material from being collected at this location on the screws.

A trowelling mechanism 128 is provided between the rearmost screw member 107 and the rearmost cylindrical roller 82. The trowelling mechanism includes an elongated bar 131 that is fixed to and extends between the side members 12 and 13. A guide structure or track 132 is mounted on the bar 131 as best illustrated in FIG. 4. In this particular embodiment, however, there are a plurality of such guides or tracks 132 mounted on the bar 131 between the side members 12 and 13. A trowel 133 is, in this particular embodiment, oriented between the bar 131 and the rearmost screw member 107. The trowel 33 includes a stainless steel platelike member 134 having a smooth bottom surface 136 thereon generally parallel to the horizontal. An upstanding plate 137 is secured to the plate 134 and has plural brackets 138 secured thereto and spaced along the length of the upstanding plate 137. A roller 139 is rotatably secured to each bracket 138 and each roller 139 is received or is guided in a guide or track 132. The top plate member 141 of each guide 132 serves to prevent the trowel 133 from becoming elevated as the machine moves over the poured flooring material. The crank arm 72 from the reciprocal drive mechanism 57 is connected to one of the brackets 138 as illustrated in FIG. 4. Thus, and in response to a rotation of the output shaft 47 of the differential gear box 38, the trowel 133 will be reciprocated along an axis extending laterally between the side members 12 and 13. The stroke of such reciprocation can be controlled by orienting the bolt 71 interconnecting the disks 64 and 69 closer or further away from the axis of rotation of the two coaxial shafts 58 and 66.

Figure 11:
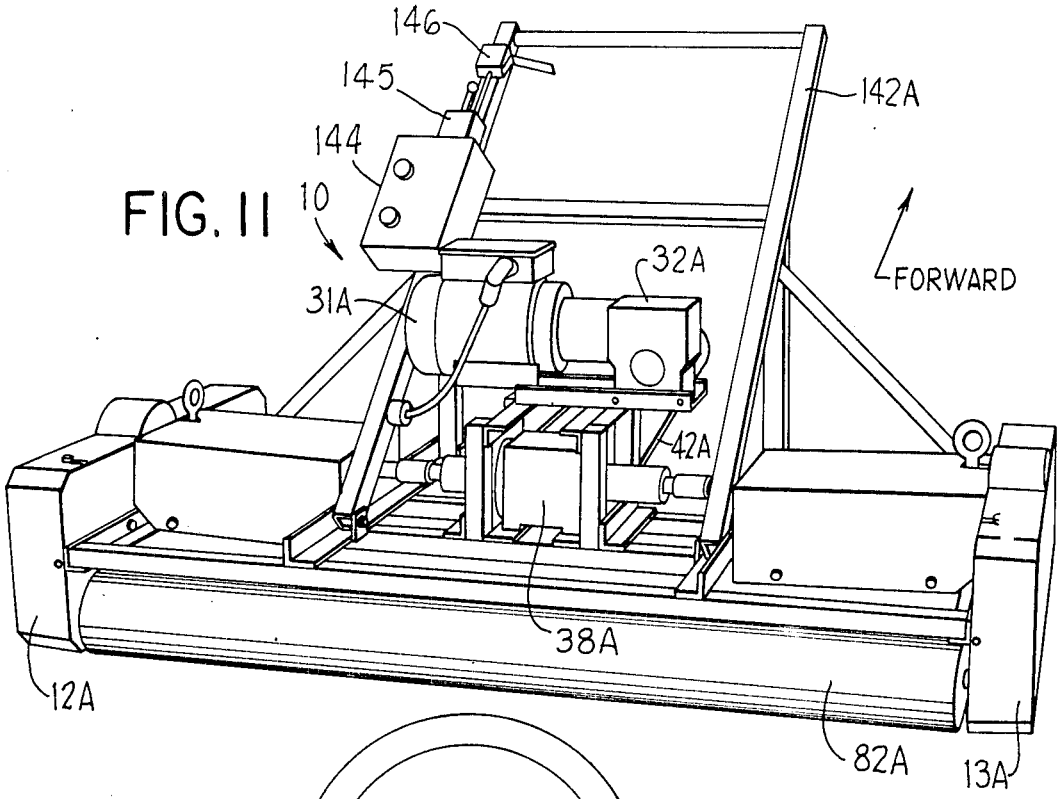
FIG. 11 is a perspective view of a second embodiment of the machine.
Figure 12:
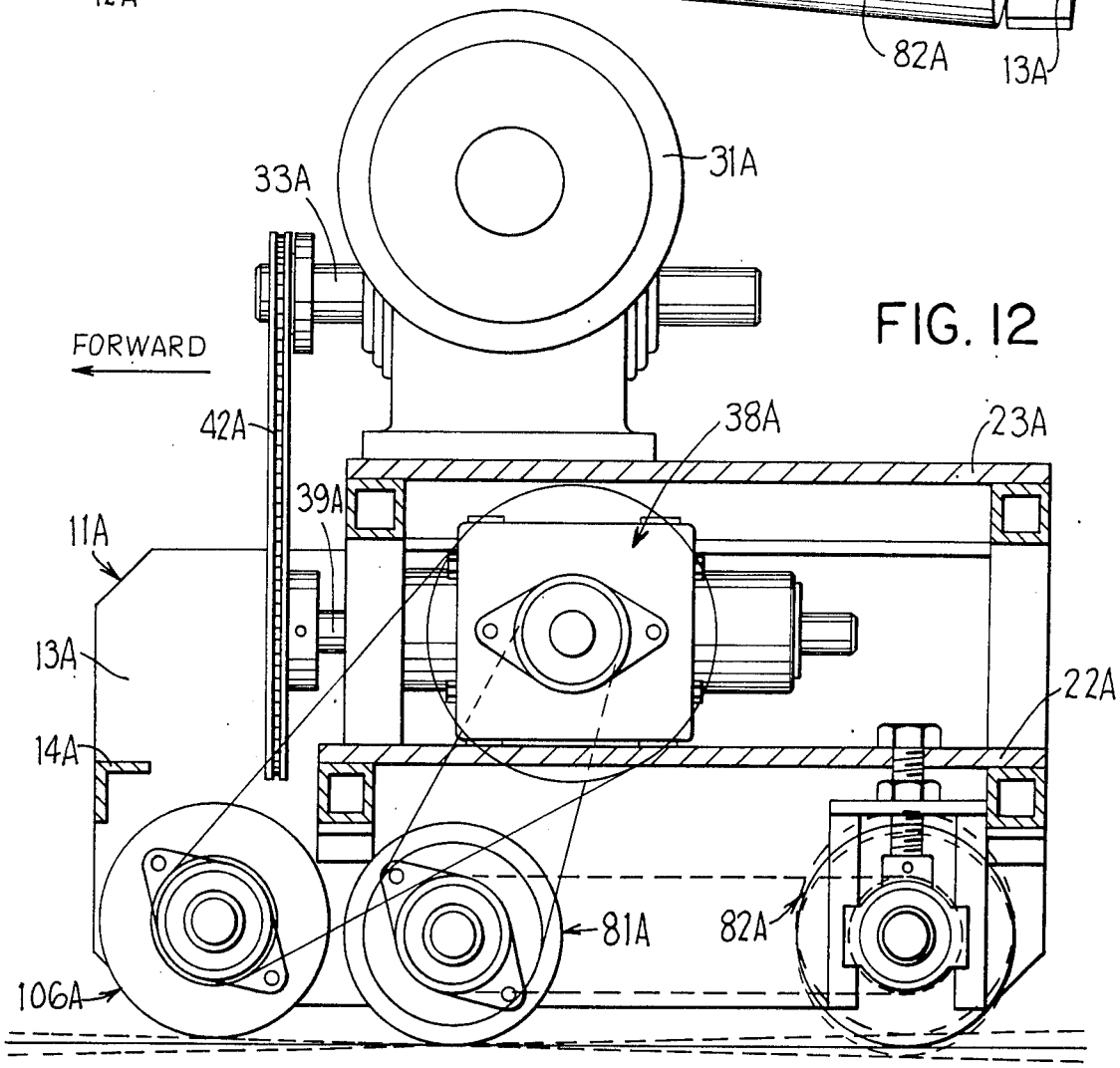
FIG. 12 is a left side view of the machine illustrated in FIG. 11 with the left side plate structure being removed.

The frame 11 includes a handle 142 (FIG. 1) on the forward side thereof. The handle 142 is composed of bracing components 143. Further, an electrical cord with a plug on the end thereof is provided for supplying electrical energy to the motor 31 and the vibratory mechanism 36. In this particular embodiment, the electrical cord with the plug on one end thereof is not illustrated. A master control box 144 is mounted on the handle 142. The starting capacitor for the motor 31 is mounted inside the box. A three-position switch 145 is oriented on the handle 142 adjacent the box 144, a first position effecting a forward driving of the machine, a second position effecting no movement and the third position effecting a rearward driving of the machine. A further switch 146 (see FIG. 11) is also provided for controlling the supply of electrical power to the master control box 144 so that when the switch 145 is, for example, in the forward position, a selective operation of the switch 146 will control the extent to which the machine is driven forwardly.

FIGS. 11 to 14 illustrate a second embodiment of the machine. The second embodiment is similar in many respects to the first embodiment of FIGS. 1 to 8. Thus, the same reference numerals will be used to designate the same components in the modified machine but will have the suffix "A" added thereto. Further, the modified embodiment of the machine illustrated in FIGS. 11 to 14 will be referred to hereinafter by the reference numeral 10A. It is believed that the components numbered with the suffix "A" added thereto will not need to be described in any further detail due to the foregoing discussion pertaining to the first embodiment of FIGS. 1 to 8. However, there are several distinctions between the first and second embodiments which are described as follows. First, it is to be noted that there is only one screw member 106A provided at the front of the frame 11A. This screw member is driven by the same structure as was described above in reference to the first embodiment. Secondly, only the rear cylindrical roller 82A is mounted for vertical adjustment by the adjustment structure illustrated in FIG. 6. The second screw member and the trowelling mechanism are not present in this modified embodiment. Further, the side members 12A and 13A each have a bushing member 151 (FIGS. 13 and 14) therein, the central axes of which are aligned with each other. The bushing members 151 each have a central opening 152 adapted to receive therein an axle 153 rotatably secured to a tire 154. An appropriate releasable locking mechanism 155 is provided on the axle 153 to hold the axle in place in the bushing member 151 and facilitate a rotation of the tire 154. When it is desired to use the machine for the purpose of compacting and leveling poured flooring material, the two wheels 154 and associated axles 153 need only be removed from the bushing members 51 and stored elsewhere while the machine is in use.

FIGS. 15 and 16 illustrate a third embodiment which is identical in all respects to the embodiment of FIGS. 11 to 14 except that a liquid reservoir 156 is provided on the frame llA and extends between the side members 12A and 13A. In this embodiment, the reservoir is a section of cylindrical PVC piping. An electrically operated pump 157 is provided for pumping liquid inside the reservoir 156 into a conduit 158 having a plurality of nozzles 159 spaced along the length thereof. In this particular embodiment, the conduit 158 extends parallel to the axle of the rearmost cylindrical roller 82A and is placed above this roller with the nozzles directing a spray pattern 161 (FIG. 61) of liquid onto the exterior surface of the cylindrical roller 82A. The purpose of this liquid spray is to keep the peripheral surface of at least the rearmost cylindrical roller 82A somewhat moist to prevent the poured floor covering from sticking thereto as the roller moves thereover. An appropriate switch 162 is provided on the handle 142A for activating the pump 157. If desired, additional conduit (not illustrated) can be provided above the screw 106A and the front roller 81A with appropriate nozzling to direct a spray pattern onto one or both of the screw 106A and front roller 81A. In this instance, the pump 157 would supply a pressurized liquid to not only the conduit 158 but also the additional and not illustrated conduit.

Since the machines 10 and 10A are electrically driven, it is necessary to supply electricity thereto through the use of an electrical cord 167. The cord can be a problematic thing to deal with as the machine is moved back and forth across the floor. Thus, I have provided a pole 168 on the frame 11 adjacent the handle 142, which pole has a hook structure 169 at the top thereof to grab and hold the cord. An appropriate support of the other end of the cord will generally be sufficient to keep the cord off from the finished or unfinished floor and make it unnecessary for the operator to be overly concerned thereabout. The height of the hook 169 above the frame 11 can be easily adjusted by any convenient means.

OPERATION

Although the operation of the machine described above will be apparent to those skilled in the art, a brief discussion of the operation will be given for convenience.

Figure 9:
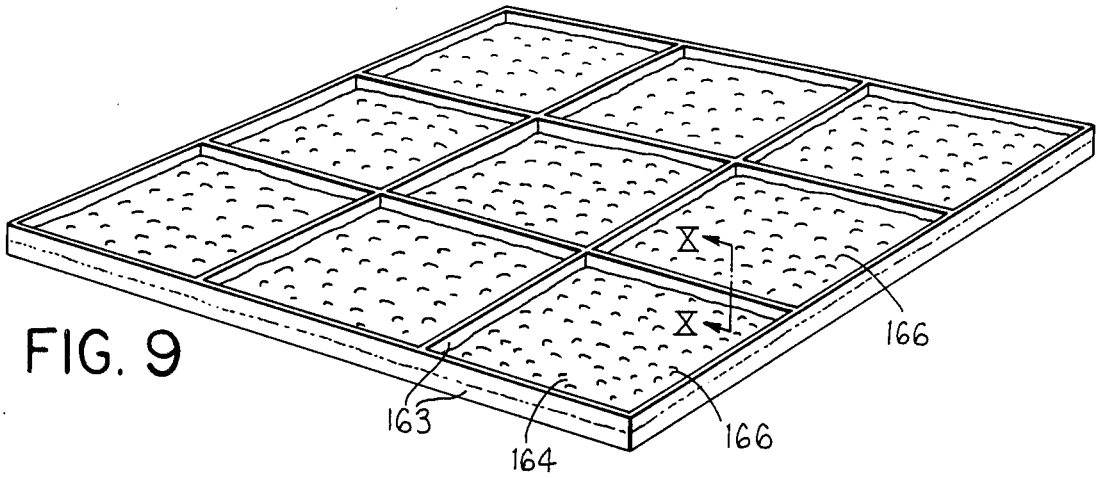
FIG. 9 is a perspective view of a floor having plural separators embedded in a concrete base prior to the pouring of floor covering thereon.
Figure 10:
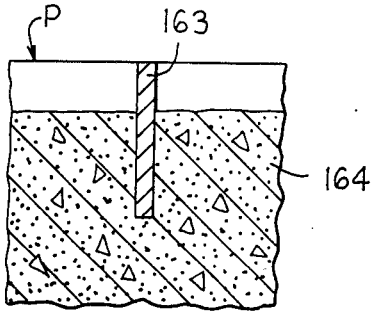
FIG. 10 is a sectional view taken along the line IX—IX of FIG. 9.

Referring first to FIGS. 13 and 14, the machine is first moved to the location whereat poured floor covering is to be compacted and leveled. Movement of the machine about the premises is made convenient by the provision of a pair of axially spaced tires 154, the diameter of such tires being sufficiently large to permit the entire frame 11, 11A to be elevated from the ground as illustrated in FIG. 13. Upon the arrival of the machine at the work site, the floor will have been prepared to the configuration illustrated in FIGS. 9 and 10. That is, plural separators 163 will have been embedded into a cement 164. The top edges of each of the separators 163 will have been carefully aligned with each other so as to define a plane P as indicated generally in FIG. 10. Next, the machine 10, 10A will be positioned on the floor with the tires 154 straddling a pair of parallel separators 163. At this point in time, the axles 153 will be pulled from each of the bushing members 151 to thereby enable the machine to rest on its two cylindrical rollers 81, 82. The length of the rollers 81 and 82 will be greater than the lateral spacing between a pair of parallel separators 163. Next, poured floor covering will be placed into each of the sectors 166 defined by, and in this embodiment, four separators 163. The operator will then move the selector on switch 146 to the forward position and then grasp the handle 142 (FIG. 1) and activate the switch 146, to effect a forward (left) movement thereof to level the poured floor covering 167 as the machine moves frontwardly. More specifically, the frontmost screw member 106 will engage the pile of floor covering 167 and distribute it evenly between the set of parallel separators 163. The spiral flights 118 will cause the floor covering 167 to move in the direction of the arrows A in FIG. 5. Further, the blades 126 and 127 will push the excess floor covering material forwardly as the machine continues to advance in the forward direction. The frontmost cylindrical roller 81 will compact the floor covering material and the next following screw member 107, if provided, (FIGS. 2 and 3) will shave off additional floor covering material and to the desired elevation above the plane P defined by the upper edge of each of the separators 163. The trowelling mechanism 128 will reciprocate laterally back and forth to further smooth the upper surface of the floor covering. The rearmost cylindrical roller 82 will further compact the floor covering thereby leaving the floor covering at the desired elevation above the plane P defined by the upper surface of the separators 163. Generally, it can be said that a single pass of the machine over the floor will be sufficient to leave the floor covering at the desired elevation above the plane P. Thereafter, and after the floor covering has hardened, a grinding machine can be utilized to further reduce the elevation of the floor covering above the plane P to the desired elevation.

Since the spiral flights 118 on each of the screw members draws the floor covering material toward the longitudinal center of the machine, passing the machine over the next adjacent row of sectors 166 will not cause any floor covering material to move onto a part of the floor that has already been finished.

If it is desired to vary the elevation of the front screw member 106 above the plane defined by the lines of contact of each of the rollers 81 and 82 with the upper edge of the separators 163, the vertical elevation of the rearmost shaft 98 associated with the cylindrical roller 82 can be adjusted to effect a raising or lowering of the frontmost screw member 106. Such vertical elevation of the shaft 98 would be in a direction tangential to an arc whose radius is the axis of rotation of the cylindrical roller 81. It is to be recognized that the shaft 83 of the frontmost cylindrical roller 81 can also be adjusted to effect a vertical adjustment in the position of the frontmost screw member 106. However, since both of the cylindrical rollers 81 and 82 can be adjusted relative to the frame 11, both can be moved in combination to adjust the elevation of the two screw members 106 and 107 to the desired elevation.

The vibratory mechanism 36 imparts a vibration to the frame 11 and rollers and screws to facilitate a spreading of the floor covering.

In the embodiment of FIGS. 11 to 16, two cylindrical rollers are provided and only one screw member is provided. Further, only the rearmost cylindrical rollers is capable of adjustment in a vertical direction to enable an alteration in the elevation of the screw member 106, particularly the theoretical cylindrical surface defined by the periphery thereof, above the plane P defined by the upper surface of the separators 163. The vibratory mechanism is not present on the embodiments of FIGS. 11 to 16.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A machine for compacting and leveling a poured floor covering, comprising:

frame means having a pair of side members;

a pair of parallel, ground engaging, cylindrical rollers;

first support means for rotatably supporting said pair of cylindrical rollers on said side members and supporting said frame means for movement in forward and reverse directions;

a screw member having a right-hand screw segment over a portion of the length thereof, and a left-hand screw segment over a remainder portion of the length thereof;

second support means for rotatably supporting said screw member for rotation on said side members and about an axis parallel to the axes of rotation of said cylindrical rollers, the theoretical cylinder defined by said screw segments being elevated above a plane defined by the lines of contact of said cylindrical rollers with said ground;

first drive means for rotatably driving said cylindrical rollers about their respective axes of rotation;

second drive means for rotatably driving said screw member about its axis of rotation so that said right-hand and left-hand screw segments engaging said poured material will effect a moving of said material to a region in front of and between said screw segments; and means on said screw member for pushing the balance of material arriving at said region between said screw segments forwardly of said machine, said means on said screw member including, in said region between said screw segments, blade means connected to and extending between mutually adjacent ends of said right-hand and said left-hand screw segments, the leveled material passing under said screw member, as said machine is moved forwardly, being compacted by successive passage beneath said cylindrical rollers.

2. The machine according to claim 1, wherein said means on said screw member further includes, in said region between said screw segments, additional blade means connected and extending along at least one of the mutually adjacent ends of said right-hand and said left-hand screw segments to further facilitate the forward pushing of said material.

3. The machine according to claim 1, wherein said frame means includes a liquid reservoir thereon, plural spray nozzle means oriented along the length of at least said rearmost roller, said spray nozzle means being oriented to direct a spray of liquid on said rearmost cylindrical roller, liquid conduit means connecting said reservoir to said plural spray nozzle means and pump means for effecting a flow of liquid from said reservoir through said conduit means and said spray nozzle means to thereby spray said liquid on said rearmost roller.

4. The machine according to claim 3, wherein said frame means additionally includes a liquid flow control means for controlling the flow of liquid to said spray nozzle means.

5. The machine according to claim 1, wherein said frame means includes a manually engageable handle on the front side of said frame means; and wherein control means are provided on said handle for controlling the driving movement of said cylindrical rollers.

6. The machine according to claim 1, wherein said frame means includes a handle on the front side of said frame means and a wheel axle receiving bracket secured to each of said side members, said wheel axle receiving brackets each having a bearing opening therein axially aligned with each other, and a wheel having an axle extending axially therefrom on at least one side thereof, said axle being releasably received in said bearing opening, the diameter of said wheels each being sufficient, when engaging the ground, to raise said cylindricl rollers of the ground to thereby facilitate a movement of said frame means from one location to another on said wheels while the operator controls such movement by manually engaging said handle.

7. The machine according to claim 6, wherein said bearing opening is oriented approximately beneath the center of gravity of said machine to thereby facilitate a balancing of said machine, when said wheels are engaging the ground, about said axles of said wheels.

8. The machine according to claim 1, wherein said first support means for the rearmost cylindrical roller on said frame means includes adjustment means for facilitating an adjustment of the axis of rotation thereof in a direction tangential to an arc whose center is the axis of rotation of the frontmost cylindrical roller so that the vertical spacing of said screw member from said plane is rendered variable.

9. The machine according to claim 8, wherein a second screw member is provided between said pair of cylindrical rollers, wherein third support means is provided for rotatably supporting said second screw member for rotation on said side members and about an axis of rotation parallel to the axis of rotation of said first screw member, and third drive means for rotatably driving said second screw member about its axis of rotation, wherein said second screw member has a right-hand screw segment over a portion of the length thereof and a left-hand screw segment over a remainder portion of the length thereof, the region between said right-hand and said left-hand screw segments being laterally offset from said region on said first-mentioned screw member.

10. The machine according to claim 9, wherein said third support means includes second adjustment means for facilitating an adjustment of the axis of rotation of said second screw member in a direction tangential to an arc whose center is the axis of rotation of the rearmost cylindrical roller so that the vertical spacing of said second screw member from said plane is rendered variable.

11. The machine according to claim 9, wherein said frame means includes a reciprocating trowelling means between said second screw member and said rearmost cylindrical roller, said trowelling means having a trowelling surface generally coplanar with said plane, third drive means for effecting a lateral reciprocation of said trowelling means, and fourth support means for maintaining said trowelling surface generally coplanar with said plane as said machine traverses said forward and reverse directions.

12. The machine according to claim 1, wherein same frame means includes a vibratory means mounted thereon for imparting a vibration to said frame means and said cylindrical rollers to further facilitate a compacting of said material.

* * * * *